US005212461A

United States Patent [19]

Aicardi et al.

[11] Patent Number: 5,212,461

[45] Date of Patent: May 18, 1993

[54] ORTHOMODE TRANSDUCER BETWEEN A CIRCULAR WAVEGUIDE AND A COAXIAL CABLE

[75] Inventors: Antonello Aicardi, Imperia; Piercarlo Massaglia, Torino, both of Italy

[73] Assignee: CSELT-Centro Studi E Laboratori Telecomunicazioni S.P.A., Torino, Italy

[21] Appl. No.: 697,770

[22] Filed: May 9, 1991

[30] Foreign Application Priority Data

May 22, 1990 [IT] Italy ..... 67371 A/90

[51] Int. Cl.[5] ..... H01P 1/16; H01P 5/12

[52] U.S. Cl. ..... 333/125; 333/137; 333/21 A; 333/26

[58] Field of Search ..... 333/125, 126, 135, 137, 333/21 A, 26; 343/756

[56] References Cited

U.S. PATENT DOCUMENTS 2,527,146 10/1950 Mumford ..... 333/26 X
3,201,717 8/1965 Grosbois et al. ..... 333/756 X
4,158,183 6/1979 Wong et al. ..... 333/21 A
4,679,249 7/1987 Tanaka et al. ..... 333/26 X
4,737,741 4/1988 Wong ..... 333/137 X

FOREIGN PATENT DOCUMENTS 11666 1/1980 Japan ..... 333/26
99602 4/1988 Japan ..... 333/135

*Primary Examiner*—Robert J. Pascal
*Assistant Examiner*—Benny Lee
*Attorney, Agent, or Firm*—Herbert Dubno

[57] ABSTRACT

The orthomode transducer between a circular waveguide and a coaxial cable consists of a circular waveguide section, into which two probes externally connected to coaxial connectors penetrate. The probe placed close to the input aperture of the waveguide is tuned by a screw and a metal plate belonging to the same axial plane and the other probe is tuned by a screw and a circular disc which closes the waveguide. The shapes of the plate and of the probes are such as to allow the best power coupling between the waveguide and the coaxial line over a wide operating band (10% of the mid-band frequency).

3 Claims, 2 Drawing Sheets

ORTHOMODE TRANSDUCER BETWEEN A CIRCULAR WAVEGUIDE AND A COAXIAL CABLE

FIELD OF THE INVENTION

Our present invention relates to microwave devices for telecommunication systems and, more particularly, to an orthomode transducer between a circular waveguide and a coaxial cable.

BACKGROUND OF THE INVENTION

To increase the capacity of transmission channels between terrestrial radio link stations or between earth stations and satellites, it is usual to use at the same time two carriers with equal frequencies and orthogonal polarizations, transmitted or received by the same reflector antenna with appropriate characteristics.

The carriers are generally separated by waveguide devices, so-called orthomode transducers, which are an integral part of the antenna feed; the transmission of respective signals to station apparatus is effected by means of separated waveguides or coaxial cables. The orthomode transducers must satisfy two requirements at the same time. They must ensure a satisfactory coupling of the radiofrequency signal between the antenna and transmission lines, consequently presenting a low stationary wave ratio. On the other hand, they must ensure a good isolation between the two access ports over a frequency band at least as wide as 10% of the mid-band frequency.

These electrical performances should be obtained by satisfying the mechanical requirements of maximum structural simplicity and small size. The latter property is important if the orthomode transducer is used in an antenna feed installed on board a satellite, either as an individual unit or as a part of an array. In the latter case, by reducing feed size, and hence feed weight and encumbrance, the satellite launching becomes simpler and cheaper.

In addition, to enable its use on board satellites, the transducer structure must have mechanical properties permitting it to remain efficient in spite of shocks suffered during the launching. More particularly, the number of parts which might change in position from a position ensuring the best electrical performance, such as the parts used for frequency tuning (namely screws), as a consequence of vibration should be minimized as far as possible.

An orthomode transducer is described on page 410 of the book entitled "Antennes micro-ondes" by Nhu BUI-HAI, issued by MASSON, in which the central conductors of two coaxial connectors are used as probes, oriented at 90° with respect to one another and connected by a waveguide section. A metal plate is secured into this guide for the tuning of the parallel probe, as it acts as a short-circuit with respect to the radiofrequency signal.

OBJECT OF THE INVENTION

It is an object of the invention to provide an improved orthomode transducer with good properties, suitable for satellite use and free from prior art drawbacks.

SUMMARY OF THE INVENTION

Higher performances can be achieved by the orthomode transducer provided by the present invention which presents a stationary wave ratio less than or equal to 1.1 over a bandwidth equal to 10% of the mid-band frequency, an isolation higher than 50 dB between the input ports and insertion losses lower than 0.05 dB. In addition, its longitudinal dimensions are reduced to about two wavelengths and there is a single tuning element (screw) per each probe, which enables easy and fast setting.

The present invention provides an orthomode transducer between the circular waveguide and the coaxial cable, consisting of a circular waveguide length, into which two probes penetrate. The two probes are placed along two diameters in orthogonal axial planes and which externally are connected to normalize impedance coaxial connectors through constant impedance waveguide transitions. The probe closest to the input inlet of the waveguide is tuned with a screw and a metal plate in the same axial plane. The other probe is tuned by a screw and a circular buffer closing the waveguide. The orthomode transducer is characterized in that the side of that metal plate opposite to the probe parallel to it is tapered towards the middle and the probes consist of different cylindrical sections with different diameters.

The first section of the probe allows the probe to be supported by a dielectric washer inserted in a circular aperture formed in the waveguide and to form with the aperture a standard impedance coaxial line. A second section of larger diameter than the first section, surrounded by a section of the aperture of lesser diameter, continues the standard impedance coaxial line. A third section of larger diameter than the second section follows. A fourth section of diameter even larger than that of the third section and a final section with a diameter and length equal to that of the third section allows the best power transfer between the waveguide and the coaxial line over a wide operating band.

Brief Description of the Drawing

The foregoing and other characteristics of the present invention will be made clearer by the following description of a preferred embodiment thereof, given by way of a non-limiting example, with reference to the annexed drawing in which.

DESCRIPTION OF THE PREFERRED EMBODIMENT

The orthomode transducer consists of a circular waveguide section WG, which presents an inner diameter equal to about 0.7 times the mid-band free-space wavelength, so as to allow the propagation of only the fundamental mode. This waveguide comprises two probes PR1 and PR2, placed along two diameters in two orthogonal axial planes (FIG. 2), which allow two different signals with orthogonal polarizations propagating in the guide to be extracted, or to be generated, according to whether the antenna system comprising the orthomode transducer is used in reception or in transmission.

The probes are fixed to the waveguide wall by respective washers RT1 and RT2 of low-loss dielectric material, inserted in circular holes of diameter D1. The narrowing of the hole to diameter D2 allows formation of a step for the washer, which thus remains blocked between the wall itself and a conical transition TR1 or TR2 (FIGS. 1 and 2), which is generally screwed to the external wall of the waveguide. This transition of known type and another equal transition for the probe PR1, not visible in FIG. 1, allows connection of the probes with external coaxial connectors of standard impedance, e.g. 50 ohm, thus avoiding any impedance discontinuity.

Figure 1:
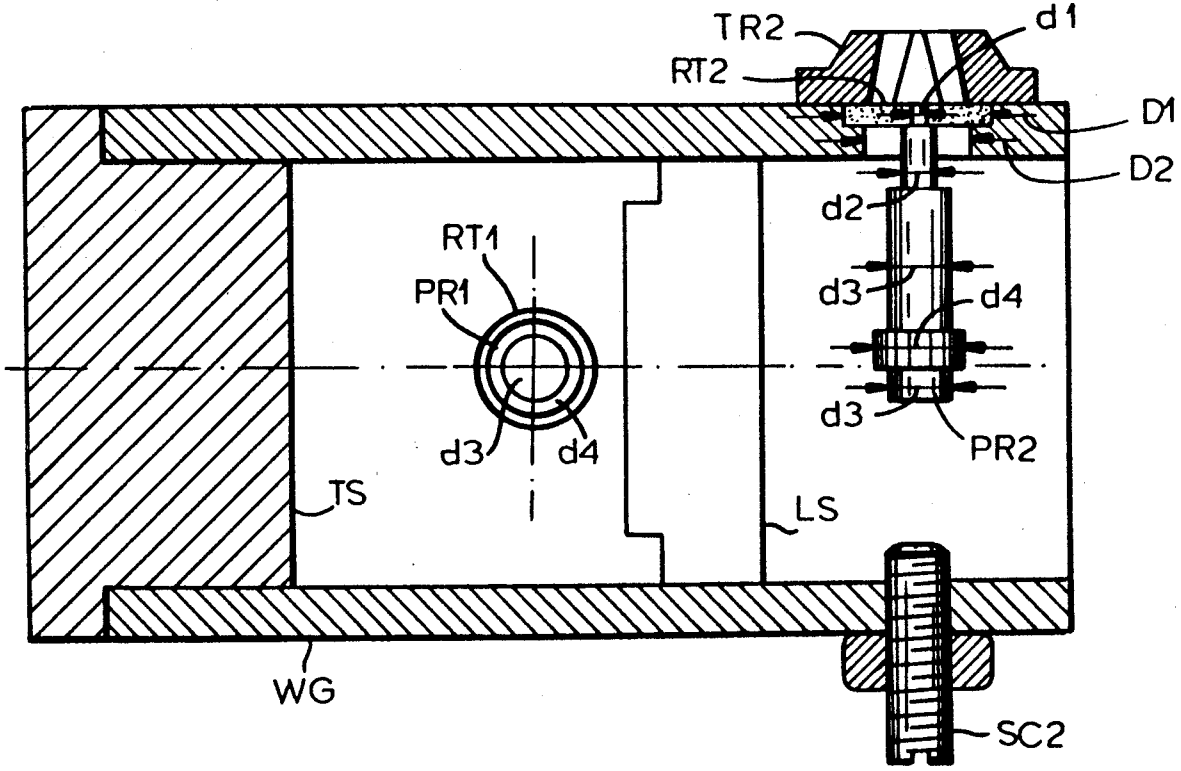
FIG. 1 is a longitudinal section of the orthomode transducer.
Figure 2:
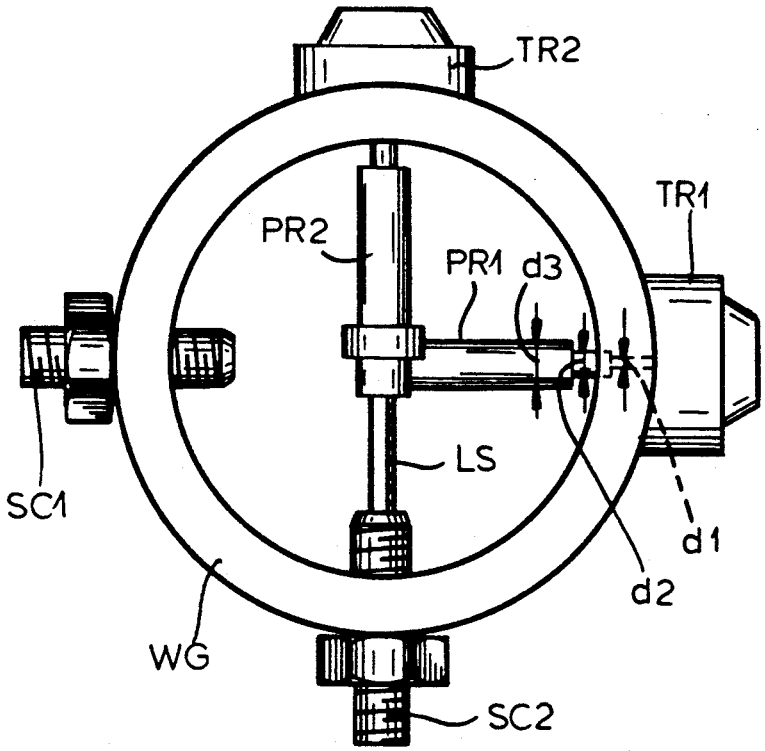
FIG. 2 is an end view thereof.

Each probe is tuned for the maximum power coupling by a short circuit and a screw. In FIG. 1, one can see the screw denoted by SC2, while both screws SC1 and SC2 are seen in FIG. 2.

Fine-tuning screws are placed in the waveguide wall in a position diametrically opposite to the probes. During tuning, the screws allow small probe and short circuit tolerances to be compensated.

The short circuit for probe PR1 is obtained by a circular disc TS, of diameter equal to the guide diameter, while for probe PR1, the short circuit is obtained by a metal plate LS (FIG. 2), in the same axial plane passing through probe PR2. This plate is thus perpendicular to the other probe PR1 and has a constant thickness equal to about 1/25 of free-space wavelength.

The plate side facing probe PR2, located close to the transducer input aperture, is rectilinear for the whole guide diameter and is parallel to the probe, while the opposite side facing probe PR1 is tapered towards the middle by two steps symmetrical with respect to the guide axis. The tapering allows a reduction equal to about 40% of interprobe distance with respect to a transducer using a nontapered plate, the performances as to electrical isolation between coaxial ports remaining the same. Of course, the reduction of interprobe space allows an equal reduction in the orthomode transducer length to be obtained.

The two probes PR1 and PR2 are equivalent and consist of various cylindrical sections of different diameter. A first section of relatively small diameter d1 lets the probe be supported by dielectric washer RT1 or RT2 and is such as to form a coaxial line having an impedance of about 50 ohm, by exploiting the hole of diameter D1 in the waveguide wall as external conductor (FIG. 1).

The impedance value is determined on the basis of the ratio D1/d1 and the dielectric constant of the washer. Analogously the larger-diameter section of diameter d2 forms a coaxial line with an impedance of about 50 ohm on the basis of the ratio with diameter D2 of the smaller section of the hole.

A section of diameter d3 larger than d2 follows. As seen in FIG. 1, a section of even larger diameter d4 follows section d3 and is followed by a further section of diameter equal to d3. Diameters d3 and d4 and penetration depth of probes inside the waveguide are optimized for the best power coupling. More particularly, the presence of the larger diameter section d4 allows good electrical performances to be attained on an operating band with an amplitude at least equal to 10% of the midband frequency.

It is clear that what is described has been given only by way of a nonlimiting example. Variations and modifications are possible without departing from the scope of the claims.

We claim:

1. An orthomode transducer, comprising:

a section of a circular waveguide having a front end, a rear end, and a cylindrical wall therebetween, said wall provided with circular holes aligned along respective axes lying in two mutually perpendicular planes, each of said holes having an outer portion with a diameter which is larger than a diameter of an inner portion of the respective hole;

a respective dielectric washer disposed in each of the outer portions of corresponding said holes;

a respective probe extending along each of said axes into an interior of said waveguide through a respective one of the holes and supported by the respective washer, one of said probes being located close to said front end and the other of said probes being located further from said front end than said one of said probes, said probes each comprising:

a first section with a diameter smaller than the remainder of the probe which is disposed in the respective washer, a second section adjacent to and connected with said first section and inwardly thereof, said second section being of a diameter larger than the diameter of said first section and defining with said inner portion of the respective hole a given coaxial impedance, a third section inwardly of and adjacent to and connected with said second section and of a diameter larger than the diameter of said second section, a fourth section inwardly of and adjacent to and connected with said third section and of a diameter greater than the diameter of said third section, and a final section inwardly of and adjacent to and connected with said fourth section and of a diameter equal to the diameter of said third section;

a respective tuning screw extending through said wall diametrically opposite each of said probes;

a tuning plate lying in said plane of the axis of said one of said probes close to said front end, axially spaced from said one of said probes and having a side facing away from said one of said probes;

a circular disk for tuning of said other probe closing said rear end of said waveguide; and respective connectors on said waveguide for said probes and coaxial with said holes, said connectors having constant-impedance transitions which can be connected to coaxial couplings with said impedance.

2. The orthomode transducer defined in claim 1 wherein said side of said tuning plate facing away from said one of said probes has two steps symmetrical with respect to an axis of said waveguide.

3. The orthomode transducer defined in claim 1 wherein said plate is of constant thickness.

* * * * *